United States Patent [19]

Rice et al.

[11] Patent Number: 4,537,452

[45] Date of Patent: Aug. 27, 1985

[54] LATERAL FILE RECEDING POSTING SHELF

[75] Inventors: Thomas E. Rice, Cheswick; Paul R. Staropoli, Pittsburgh, both of Pa.

[73] Assignee: Haskell of Pittsburgh, Inc., Verona, Pa.

[21] Appl. No.: 425,664

[22] Filed: Sep. 28, 1982

[51] Int. Cl.[3] ..... A47B 77/10

[52] U.S. Cl. ..... 312/314; 312/282; 312/323

[58] Field of Search ..... 248/240.4; 312/282, 312/325, 314, 317, 327, 328, 322, 323, 281, 241; 108/40, 134, 135

[56] References Cited

U.S. PATENT DOCUMENTS

| | | | |
|---|---|---|---|
| 624,115 | 5/1899 | Steele | 248/240.4 |
| 1,700,545 | 1/1929 | Sanders | 312/241 |
| 2,210,648 | 8/1940 | Battelle | 312/317 R |
| 2,775,501 | 12/1956 | Kyllo | 312/323 |
| 3,079,206 | 2/1963 | Glezen | 312/323 |
| 3,153,526 | 10/1964 | Pawsey | 248/240.4 |
| 3,174,162 | 3/1965 | Sinton | 248/240.4 |
| 3,836,223 | 9/1974 | Signore | 312/356 |

*Primary Examiner*—William E. Lyddane
*Assistant Examiner*—Joseph Falk
*Attorney, Agent, or Firm*—Webb, Burden, Robinson & Webb

[57] ABSTRACT

In a lateral file of the receding door type, the improvement comprising support means retained on the underside of a receding door for engagement with the front file frame vertical edges to retain the door in a horizontal position as a posting shelf. The support means includes left hand and right hand support brackets which are retained against the recessed door inner surface, are manually movable into engagement with the file frame and are automatically returnable to the door inner surface to permit door closing or receding door movement into the file frame.

7 Claims, 8 Drawing Figures

LATERAL FILE RECEDING POSTING SHELF

FIELD OF THE INVENTION

Our invention relates to filing cabinets and more particularly to lateral files of the receding door type.

DESCRIPTION OF THE PRIOR ART

Lateral files include a plurality of drawer spaces to accommodate files and the like. In one form of file cabinet these drawer spaces are closed off by door fronts which have the capability of receding into the file frame. Receding doors typically ride on a trackway or track lip connected to the solid frame of the file. The doors are attached to a sliding support such as a scissor back support and are movable from a closed position in which the drawer space is not exposed to an open position in which the door has been pivoted upward and slid into the lateral file frame thereby exposing the drawer space.

Heretofore when it has been desired to provide a posting and utility shelf in conjunction with a lateral file, the shelf has been a component separate and apart from the door or file drawer and has slid in and out from the lateral file on its own separate trackway. To provide for such a posting shelf it is necessary to supply support structure for the trackway in addition to the shelf itself. The existing shelves are free to flap in the channel in which they ride and therefore have limited use where a rigidly held planar surface is required or any type of load bearing capacity is needed.

The office equipment manufacturers have established industry recognized file heights so that a user may substitute files or purchase files from several manufacturers all of which have a common height. Where a lateral file includes a separate posting shelf, this common height is either disrupted or a sacrifice must be made in the drawer space to accommodate the excess hardware necessary for the posting shelf.

SUMMARY OF THE INVENTION

We have been able to eliminate the extra components associated with a standard posting shelf for a lateral file having a receding door front. Our posting shelf does not take up extra space and therefore maximum storage capacity is provided for any given file height. We have provided a door front which functions as a posting shelf and in that capacity is rigidly held in place to accommodate reasonable loads.

All of this is provided with support members which automatically return into the door recess on the back side thereof when not in use. Our improvement comprises a support means retained on the underside of the door and which is movable into engagement with the file frame so as to retain the door as a posting shelf. This support means includes left hand and right hand supports mounted on opposite sides of the door. The supports are spring loaded to retract to the underside of the door. Each support comprises a mounting bracket attached along the door edge spaced from the file frame, a shelf support bracket having a first section connected to the mounting bracket through a spring loaded hinge and a second section extending at an angle from the first section. A channel member connects to the second section to receive the file frame with said angle causing the channel member to be codirectional with the file frame for receiving it in mating relationship.

DESCRIPTION OF THE PREFERRED EMBODIMENTS

Figure 1:
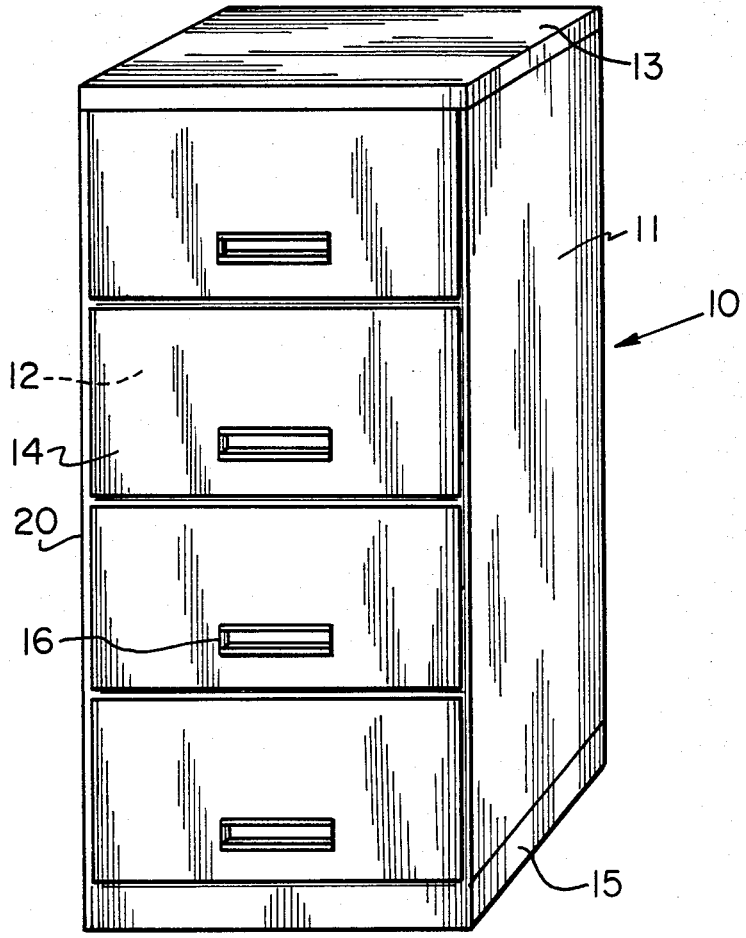
FIG. 1 is a perspective view of a receding door lateral file cabinet.
Figure 2:
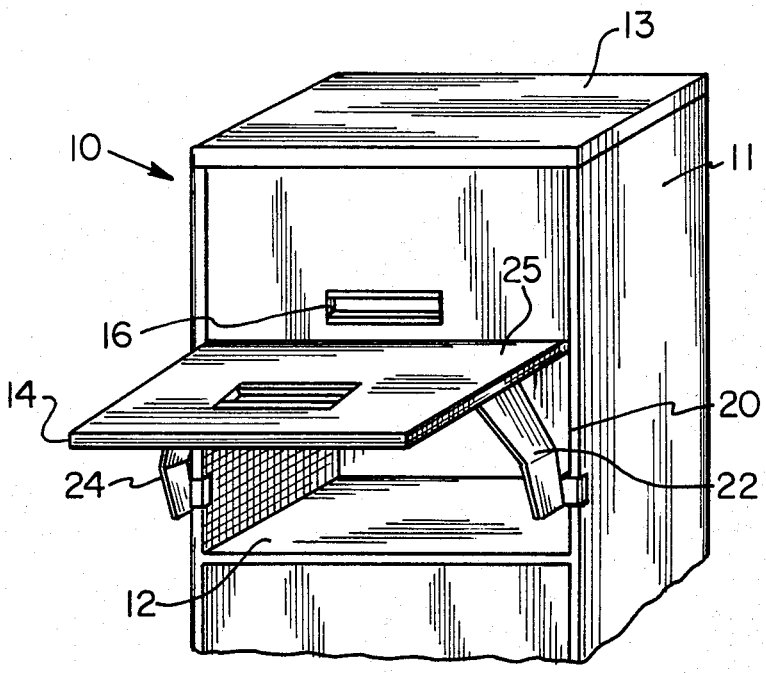
FIG. 2 is a perspective view of a portion of the file cabinet of FIG. 1 in which a door front acts as the posting shelf.

Our lateral filing cabinet, generally designated 10, is formed of panel sides 11, a top 13 and a base 15, all of which are connected to a rigid main frame (not shown) of the type commonly employed for receding door file cabinets, FIGS. 1 and 2. The lateral filing cabinet 10 includes a plurality of storage shelves 12 positioned in vertical alignment. Each open space exposing a shelf 12 is closed off by means of a door 14. Doors 14 are opened and closed by means of recessed handles 16.

The doors 14 are capable of being recessed into the cabinet 10 by means of a trackway or track lip and a back support such as a scissor back support pivotally attached to the door, all of which are known in the art and do not form a part of this invention. Our invention provides support means for retaining the door 14 in a horizontally open position prior to being recessed into the file cabinet so as to serve as a posting shelf. Normally a single posting shelf is required and such a posting shelf is located between the third and fourth door in a four or five door lateral file cabinet. Our invention is equally applicable to any or all of the doors of such a cabinet.

We provide a pair of support members comprised of a right hand bracket 22 and a left hand bracket 24 for engaging the front file vertical edges 20 to retain the door in the open position, FIG. 2. The engagement of the edges 20 is in the area above the shelf 12 which has been exposed by opening the particular door 14. The door 14 is comprised of a front flat surface 25, a rear surface 26 and a partial border of L-shaped member 27 (bent formed from surface 25) so as to define a recessed area 28 adjacent the rear surface 26 and which accommodates the mounting brackets 22 and 24, FIGS. 3 through 5.

Figure 5:
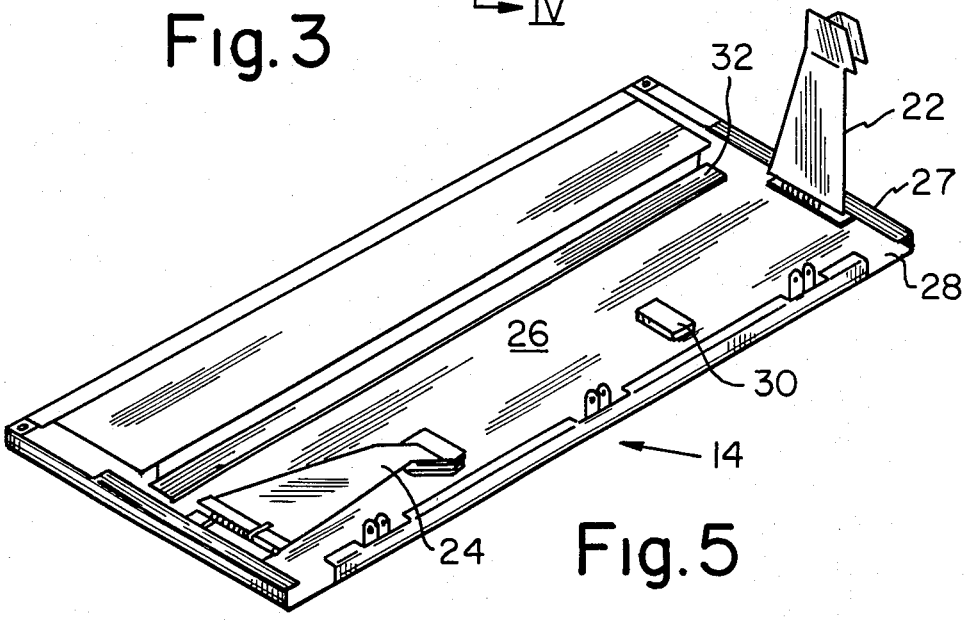
FIG. 5 is a perspective view showing the underside of the posting shelf door.

The door 14 also includes other types of functional structure along its rear surface 26 such as a stiffening member 32 and the various members for connecting to the conventional back support, FIG. 5. As will be explained in more detail hereinafter the brackets 22 and 24 automatically return into the recess area 28 so that the door 14 may be slid into receding engagement within the file cabinet in the conventional manner. A rubber bumper 30 or other form of sound deadener attaches to the rear surface 26 of door 14 to receive the mounting brackets 22 and 24 respectively in the return position.

Figure 7:
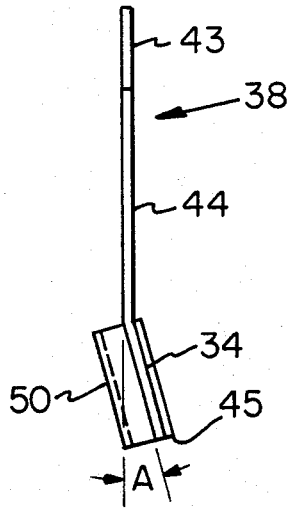
FIG. 7 is an end view of the bracket of FIG. 6.
Figure 6:
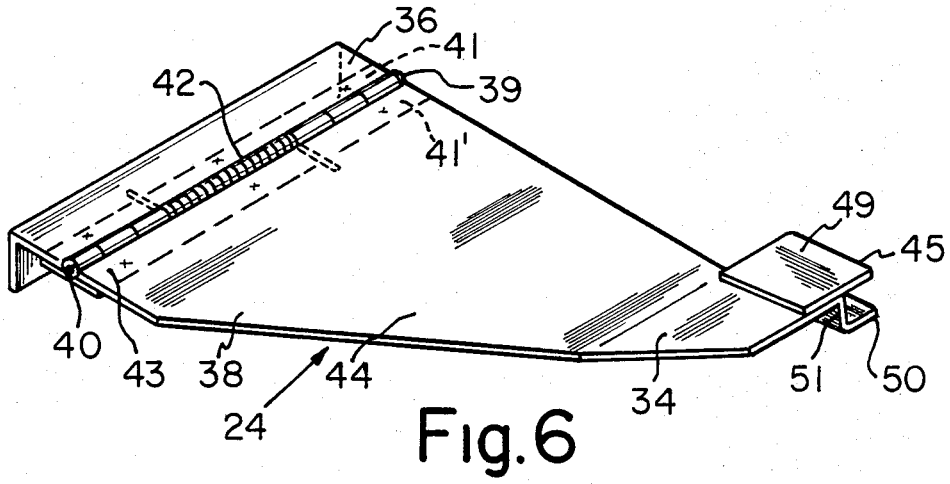
FIG. 6 is a perspective view of a left hand mounting bracket.

The details of a mounting bracket 24 are best seen in FIGS. 6 and 7. While the left hand bracket 24 is illustrated, it will be recognized that the right hand bracket 22 is identical so as to form a mirror image therewith when mounted opposite from the left hand bracket 24.

Each bracket is formed of a member which mounts to the door interior surface and a door support member which connects to the mounting member through a spring loaded piano hinge. Specifically, the mounting member is an angle 36 which is welded to the door inner surface 26 and to the L-shaped door edge 27, FIGS. 5 and 6. The angle 36 is located slightly rearward of the midpoint along the door depth to provide optimum support for door 14.

The piano hinge 40 comprises hinge plates 41 and 41' which are welded to angle 36 and door support bracket 38 respectively, FIG. 6. Sleeves extend from each hinge plate in alternate relationship so as to form a continuous sleeve to accommodate hinge pin 39 which extends the length of the hinge 40. Midway of the hinge 40 is a sleeveless section which accommodates a helical spring 42 about the pin 39. Spring 42 is locked into both the angle 36 and the door support bracket 38 so as to retain angle 36 and bracket 38 in a common plane in the relaxed condition.

Bracket 38 includes the connecting section 43 which has welded to it the hinge plate 41' and a mounting channel section 44 which is bent formed to include a distal section 34 forming an angle A with the remainder of the channel section 44, which angle is on the order of 15°, FIGS. 6 and 7. The mounting channel 45 extends outward from the distal section 34. Mounting channel 45 is formed of flange 49 welded to the distal section 34 and web 51 and flange 50 which are bent formed from the distal section 34 of mounting channel section 44.

Figure 8:
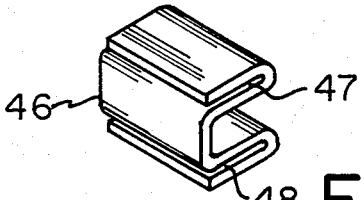
FIG. 8 is a perspective view of the rubber molding which attaches to the mounting bracket.

A rubber molding 46 (FIG. 8) having spaced grooves 47 and 48 accommodates flanges 49 and 50 of mounting channel 45 so as to prevent marring of the cabinet edges 20. Appropriately coating channel 45 with rubber or other non-marring material can accomplish the same purpose.

Figure 4:
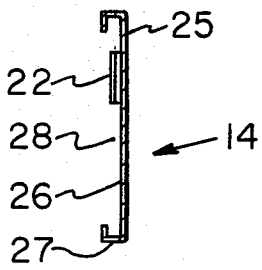
FIG. 4 is a section taken along section lines IV—IV of FIG. 3.
Figure 3:
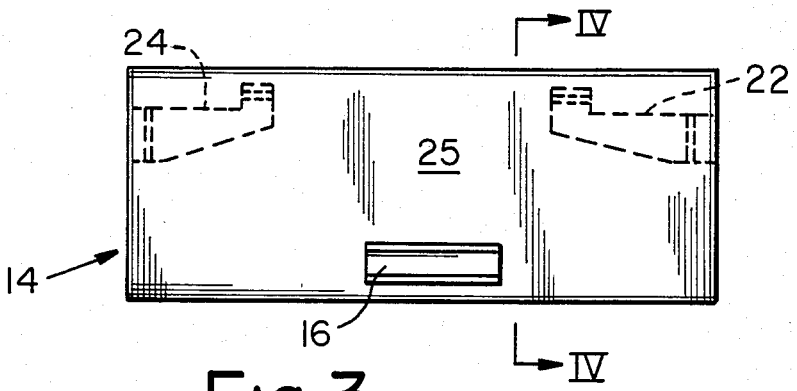
FIG. 3 is a front view of a door showing the mounting brackets in phantom.

When the door 14 is closed the mounting brackets 22 and 24 are flat against the inner surface 26 of the door 14 and within the recessed area 28, FIGS. 3 and 4. When the door 14 is open to the posting shelf position, the support brackets 22 and 24 are pulled down from behind the door and fitted onto the edges 20 of the cabinet 10, FIG. 2. Specifically the rubber molding 46 or the coated mounting channel is codirectional with and accommodates the front vertical edges 20 in mating relationship. To return the door 14 to the closed position or to recede the door 14 within the cabinet 10, the door 14 is lifted up slightly, thereby disengaging the brackets 22 and 24 from the edges 20 and allowing the spring loaded supports to return into the door interior. This then frees the door from the shelf position allowing it to either close or be receded in the cabinet in the conventional manner. Because the brackets are within the recess formed by the door frame, the brackets do not interfere with receding the door into the cabinet.

While we have illustrated a preferred embodiment of our invention it will be recognized that it may be otherwise embodied within the scope of the appended claims.

We claim:

1. A lateral file of the receding door type comprising:

A. a main frame bounded by parallel vertical front edges;

B. a plurality of vertically spaced drawer spaces for receiving files;

C. pivotal door fronts for closing off the drawer spaces and bent formed to include a planar outer front surface and sides forming a recessed inner surface;

D. means positioned above each of said drawer spaces and connected to the frame for receiving the door of said drawer space in receding relationship within the frame; and E. right hand and left hand door supports, each located on opposite ends of at least one door to support the door as a posting shelf and including:

i. a mounting member attached to the inner surface along a door side;

ii. a spring loaded hinge attached to said mounting member; and iii. a shelf support bracket having a first section connected to the spring loaded hinge inward of the door side, a second section extending at an angle from said first section and a channel member extending from said second section, said bracket being movable from a home position adjacent to the inner surface and contained within the door recess to a supporting position wherein the channel member engages the file front edge to support the door in a substantially horizontal position and said bracket being automatically returnable to said home position when disengaged from said edge by said spring loaded hinge.

2. The improvement of claim 1, said support means including left hand and right hand supports mounted on opposite sides of said door, each of said supports being mounted to a spring mechanism which is in turn mounted to said inner surface, whereby each spring mechanism is loaded to retract the supports to the inner surface.

3. The file of claim 1 including a sound deadening bumper mounted to said door inner surface to engage the shelf support bracket in the home position.

4. The file of claim 1, said channel member including a non-marring receiving surface.

5. The file of claim 1, said mounting bracket formed of a two sided angle, one side being welded to the door side and the other being welded to said inner surface.

6. The file of claim 5, said hinge comprising a piano hinge having two hinge plates joined by a pin, one hinge plate connected to the mounting bracket and the other hinge plate connected to the shelf support bracket and a helical spring positioned at the pin intermediate its ends and locked to each of said mounting bracket and support bracket.

7. In a lateral file having a frame and including a receding door having a front surface and an inner surface and movable between a closed position in which the door is substantially vertical, an open position in which the door is open and extending substantially horizontal, and a receded position in which the door has been slid inward from the open position into the file frame, the improvement comprising support means retained on the inner surface of the door and movable into engagement with the file frame to retain the door in the open position as a posting shelf, said support means including left hand and right hand supports mounted on opposite sides of said door, said supports each comprising a mounting member attached along a door edge spaced from the file frame in the open position, a spring loaded hinge attached to said mounting member, and a shelf support bracket having a first section connected to the spring loaded hinge inward of the door edge and a second section extending at an angle from said first section and a channel member connected to said second section to receive said file frame, said angle causing said channel member to be aligned with said file frame and engaged therewith when the door is retained in the open position as a posting shelf.

* * * * *

UNITED STATES PATENT AND TRADEMARK OFFICE

CERTIFICATE OF CORRECTION

PATENT NO. : 4,537,452

DATED : August 27, 1985

INVENTOR(S) : Thomas E. Rice et al.

It is certified that error appears in the above-identified patent and that said Letters Patent is hereby corrected as shown below:

Column 4 - Delete lines 24 to 30 and insert:

— 2. The file of Claim 1, said angle being on the order of 15°.—.

Signed and Sealed this

*Twelfth* Day of *November 1985*

[SEAL]

*Attest:*

DONALD J. QUIGG

*Attesting Officer*

*Commissioner of Patents and Trademarks*